United States Patent [19]

Jarvi

[11] Patent Number: 4,789,409

[45] Date of Patent: Dec. 6, 1988

[54] BLACK CONVERSION COATING

[75] Inventor: Paul R. Jarvi, Orange, Conn.

[73] Assignee: Mitchell Bradford International Corp., Milford, Conn.

[21] Appl. No.: 938,552

[22] Filed: Dec. 5, 1986

[51] Int. Cl.[4] ..... C23C 22/58

[52] U.S. Cl. ..... 148/6.24

[58] Field of Search ..... 148/6.24

[56] References Cited

U.S. PATENT DOCUMENTS 4,061,830 12/1977 Greenberg ..... 148/6.24

FOREIGN PATENT DOCUMENTS 0122879 9/1980 Japan ..... 148/6.24

OTHER PUBLICATIONS

Metal Coloring, Fishlock 1962, pp. 119–120.

*Primary Examiner*—Sam Silverberg

*Attorney, Agent, or Firm*—Ostrolenk, Faber, Gerb & Soffen

[57] ABSTRACT

A black conversion coating for substrates contains sodium thiosulfate, nickel sulfate (pentahydrate), zinc sulfate (monohydrate), and sodium fluoborate. The coating comes in a powdered formulation in which the sodium thiosulfate, nickel sulfate, zinc sulfate, and sodium fluoborate comprise, respectively, 54%, 30%, 15% and 1% by weight of the formulation. The powdered matter is mixed with water at a concentration of 30–60 grams per liter of water. The coating is applied at a liquid temperature of 160°–180° F.

14 Claims, No Drawings

BLACK CONVERSION COATING

BACKGROUND OF THE INVENTION

The present invention is directed to a formulation for a black conversion coating and in particular to a conversion coating which provides a consistent and adherent black finish on nickel and nickel-plated substrates.

Black conversion coatings are applied to various substrates. Often, the coating is a black non-electrolytic conversion coating which is applied to nickel and nickel-plated substrates. One known formula has been used for many years which formula did not perform satisfactorily in production situations. The known formula is a liquid concentrate to which three parts by volume of water is added to one part of the liquid concentrate. The formulation is used at a temperature of 180° F.

The known coating formulation produces an inconsistent black finish on nickel and nickel-plated substrates and both the concentrate and the working solution have very minimal shelf life. The liquid concentrate is formulated from sodium thiosulfate and cobalt sulfate, each of which comprises, respectively, 175 grams and 100 grams per liter of water.

DETAILED DESCRIPTION OF A PREFERRED EMBODIMENT

It is an object of the present invention to provide a black conversion coating formulation with good adhering and consistency characteristics.

It is another object of the present invention to provide a black conversion coating which has a long shelf life.

It is still another object of the present invention to provide a black conversion coating formulation which is usable over a greater temperature range.

The foregoing and other objects of the invention are realized with a novel formulation for a black conversion coating comprised of a powdered material which includes sodium thiosulfate, nickel sulfate (pentahydrate), zinc sulfate (monohydrate), and sodium fluoborate. The sodium thiosulfate is about 50–60% by weight of the powder, the nickel sulfate is about 25–35% by weight, the zinc sulfate is from 10–20% by weight, and the sodium fluoborate is about 0.5–1.5% by weight of the powder. Good results are obtained with a formulation wherein the elements are mixed in the ration of 5:3:1.5:0.1, respectively for the sodium thiosulfate, nickel sulfate, zinc sulfate and sodium fluoborate.

The powdered material is mixed with water to obtain a concentration of 25–75 grams, preferably 30–60 grams, of material per liter of water and the liquid coating is usable at a temperature of about 160°–180° F.

The powdered formulation has an indefinite shelf life and the shelf life of the working solution is dramatically increased. The coating of the present invention provides a better adhering and a more consistent black finish, particularly on nickel and nickel plate substrates.

In a preferred embodiment of the present invention, the powdered formulation includes the following elements in the indicated ratios:

| | |
|---|---|
| Sodium Thiosulfate | 54% by wt. |
| Nickel Sulfate (pentahydrate) | 30% by wt. |
| Zinc Sulfate (monohydrate) | 15% by wt. |
| Sodium Fluoborate | 1% by wt. |

As noted above, the powdered formulation is mixed with water at a concentration of 30–60 grams per liter of water and the coating is used at a temperature of 160°–180° F.

The formulation was described above to include sodium fluoborate. It should be noted, however, that the formulation is useful even without the sodium fluoborate to slowly blacken electrolytic nickel.

Other fluoride compounds such as sodium, silicofluoride, ammonium silicofluoride, sodium bifluoride and ammonium bifluoride may be substituted in place of the sodium fluoborate. Ammonium nitrate and ammonium chloride may be used in place of the sodium fluoborate as accelerators but the fluoborate is preferred since ammonia chelates (ties up) metal ions and thus interferes with the subsequent treatment of the effluent. Further, other nickel-containing compounds such as nickel chloride and nickel nitrate may be substituted for the nickel sulfate although the latter is the compound of choice.

Although the present invention has been described in relation to specific embodiments thereof, many other variations and modifications and other uses will now become apparent to those skilled in the art. It is preferred, therefore, that the present invention be limited not by the specific disclosure herein, but only by the appended claims.

What is claimed is:

1. A non electrolytic conversion coating composition which forms a black surface comprising sodium thiosulfate, a nickel-containing compound, zinc sulfate (monohydrate) and a fluoride compound.

2. The coating of claim 1, wherein said nickel-containing compound comprises nickel sulfate (pentahydrate) and wherein said fluoride compound comprises sodium fluoborate.

3. The coating of claim 2, in which the sodium thiosulfate, nickel sulfate (pentahydrate), zinc sulfate (monohydrate), and sodium fluoborate comprises, respectively, 50–60%, 25–35%, 10–20% and 0.5–1.5% by weight of said coating.

4. The coating of claim 3, in which the sodium thiosulfate, nickel sulfate (pentahydrate), zinc sulfate (monohydrate), and sodium fluoborate are provided, respectively, in the ratio of 5:3:1.5:.01.

5. The coating of claim 1, in which said nickel-containing compound is selected from the group of nickel sulfate (pentahydrate), nickel chloride, and nickel nitrate.

6. The coating of claim 3, in which the sodium thiosulfate, nickel sulfate (pentahydrate), zinc sulfate (monohydrate), and sodium fluoborate comprise, respectively, about 54%, 30%, 15% and 1% by weight of said coating.

7. The coating of claim 6, further comprising water mixed with said coating, the non-water part of said coating comprising 25–75 grams per liter of said water.

8. The coating of claim 7, in which said non-water part comprises 30–60 grams per liter of said water.

9. The coating of claim 8, in which the water is at a temperature of between 160° F. to 180° F.

10. The coating of claim 1, in which said fluoride compound is selected from the group of sodium fluoborate, sodium fluoride, sodium silicofluoride, ammonium silicofluoride, sodium bifluoride and ammonium bifluoride.

11. A method for coating a substrate, comprising the steps of:

obtaining a powdered concentrate containing sodium thiosulfate, nickel sulfate (pentahydrate), zinc sulfate (monohydrate), and sodium fluoborate in a proportion of about 54%, 30%, 15% and 1% by weight;

mixing said powdered concentrate with water in a ratio of 30–60 grams of said concentrate per liter of said water to generate a liquid coating; and applying said liquid coating to said substrate.

12. The method of claim 11, in which said substrate comprises nickel or nickel-plated substrates.

13. The method of claim 11, further comprising the step of maintaining said liquid coating at a temperature between 160°–180° F. during the application of said liquid coating to said substrate.

14. A non electrolytic conversion coating composition which forms a black surface comprising sodium thiosulfate, a nickel containing compound, zinc sulphate (monohydrate), and a compound selected from the group of ammonium nitrate and ammonium chloride.

* * * * *